US007360257B2

(12) United States Patent
Friedland et al.

(10) Patent No.: US 7,360,257 B2
(45) Date of Patent: Apr. 22, 2008

(54) BIB WITH ADHESIVE STRIP

(75) Inventors: Frank Friedland, Boca Raton, FL (US); Michael B. Chasan, Boca Raton, FL (US)

(73) Assignee: Napkleen LLC, Boca Raton, FL (US)

( * ) Notice: Subject to any disclaimer, the term of this patent is extended or adjusted under 35 U.S.C. 154(b) by 70 days.

(21) Appl. No.: 11/362,321

(22) Filed: Feb. 24, 2006

(65) Prior Publication Data

US 2007/0199123 A1 Aug. 30, 2007

(51) Int. Cl.
*A41B 13/10* (2006.01)

(52) U.S. Cl. ..... 2/49.1

(58) Field of Classification Search ..... 2/46, 2/48, 49.1–49.5, 52, 50, 51, 88, 104, 114, 2/94, 102; 206/541, 542, 549, 494, 438; 224/148.1, 148.4, 148.5, 576
See application file for complete search history.

(56) References Cited

U.S. PATENT DOCUMENTS 2,224,746 A * 12/1940 Richstein ..... 2/48
2,424,680 A 7/1947 Doyle
2,763,867 A 9/1956 Chagnon
2,803,574 A 8/1957 Payant
3,146,465 A 9/1964 Hummel
3,221,341 A 12/1965 Hummel
3,329,969 A 7/1967 Farber et al.
3,619,816 A 11/1971 Cowen
3,675,274 A 7/1972 Fried et al.
3,793,644 A * 2/1974 Kellner ..... 2/48
4,306,316 A 12/1981 Klepfer
4,423,523 A 1/1984 Bodner et al.
4,441,212 A * 4/1984 Ahr et al. ..... 2/49.2
4,601,065 A 7/1986 Sigl et al.
4,660,226 A 4/1987 Quilling et al.
4,779,288 A 10/1988 Mack
D299,282 S 1/1989 Winans
4,977,626 A * 12/1990 Smith ..... 2/250
4,995,641 A 2/1991 Landry et al.
5,030,491 A 7/1991 Shoesmith
5,033,620 A 7/1991 De Luca
5,476,697 A 12/1995 Bellander (Continued)

FOREIGN PATENT DOCUMENTS

GB 993838 6/1965

(Continued)

OTHER PUBLICATIONS

Web-site www.graphicice.com/index.php?action=prodspec &itemID=39419.

*Primary Examiner*—Amy B. Vanatta
(74) *Attorney, Agent, or Firm*—Martin Fleit; Paul D. Bianco; Fleit Kain Gibbons Gutman Bongini & Bianco, P.L.

(57) ABSTRACT

A bib for protecting clothing worn by a wearer includes a sheet having front and back surfaces, an adhesive strip located on the back surface of the sheet and configured and dimensioned for adhering the sheet to the wearer, and a sealed package attached to the sheet. The sealed package includes at least one towelette configured and dimensioned for cleansing.

11 Claims, 6 Drawing Sheets

U.S. PATENT DOCUMENTS

| | | | | |
|---|---|---|---|---|
| 5,552,200 | A | 9/1996 | Gureff | |
| 5,640,716 | A | 6/1997 | Oldham | |
| 5,672,056 | A | 9/1997 | Fisher et al. | |
| 5,799,336 | A * | 9/1998 | Cooper | 2/247 |
| 5,875,490 | A * | 3/1999 | Woodard et al. | 2/49.1 |
| 6,000,056 | A * | 12/1999 | Brady et al. | 2/49.1 |
| 6,021,550 | A | 2/2000 | Welch | |
| 6,079,048 | A | 6/2000 | Campbell | |
| 6,212,683 | B1 | 4/2001 | Liebmann | |
| 6,219,846 | B1 * | 4/2001 | Toole | 2/49.2 |
| 6,256,788 | B1 | 7/2001 | Loewer et al. | |
| 6,342,297 | B1 | 1/2002 | LaBrash | |
| 6,493,879 | B1 | 12/2002 | Hibler | |
| 6,548,135 | B1 * | 4/2003 | Hershey et al. | 428/40.1 |
| 6,884,494 | B1 | 4/2005 | Curro et al. | |
| 2002/0029400 | A1 * | 3/2002 | Smith | 2/48 |
| 2004/0224116 | A1 | 11/2004 | Manasa | |
| 2005/0144693 | A1 * | 7/2005 | Hagen | 2/49.1 |
| 2005/0269217 | A1 | 12/2005 | Farmer | |
| 2007/0006357 | A1 * | 1/2007 | Hall | 2/49.1 |
| 2007/0061938 | A1 * | 3/2007 | Reimer | 2/48 |
| 2007/0143904 | A1 | 6/2007 | Brown | |
| 2007/0199123 | A1 | 8/2007 | Friedland et al. | |
| 2007/0220651 | A1 | 9/2007 | Friedland et al. | |

FOREIGN PATENT DOCUMENTS

| | | |
|---|---|---|
| GB | 1095397 | 12/1967 |
| WO | WO 87/06105 | 10/1987 |

* cited by examiner

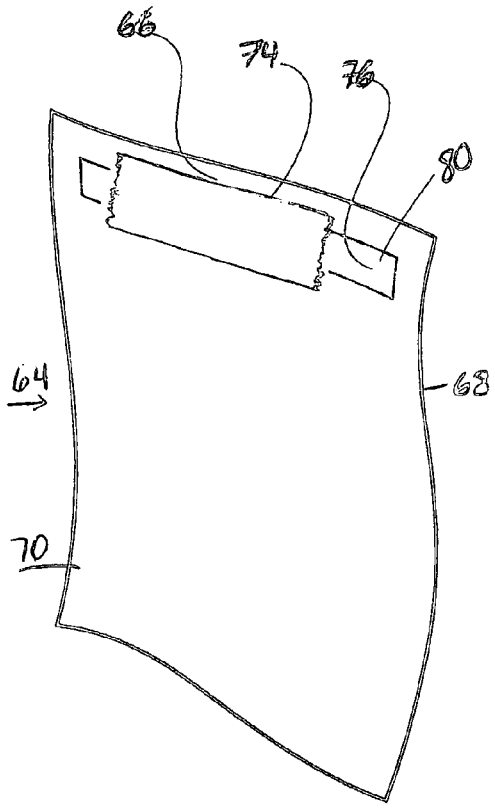
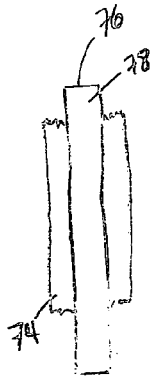
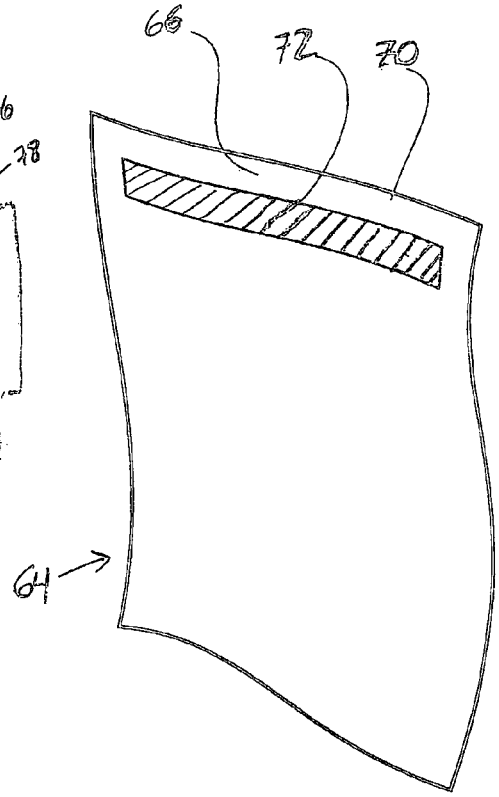
Figure 3a
Figure 3b

BIB WITH ADHESIVE STRIP

FIELD OF THE INVENTION

The present invention relates to protective coverings for clothing, and more particularly to bibs for adults and children.

BACKGROUND OF THE INVENTION

One common definition of a bib is a small piece of material fastened under a chin to protect the clothing while eating. As a result, bibs have a connotation that typically associates their use with infants and toddlers. In fact, adults are generally much less apt to spill or splatter food onto their clothing compared to children. Nevertheless, there are certain situations in which it is appropriate or desirable for an adult to don a bib. Such a bib may either be a conventional bib or simply a tucked or otherwise secured napkin covering the chest.

Conventional bibs typically have two strings which tie around the neck to hold the bib in place. Other bibs use snaps, ties, strings, hook and loop fasteners, or the like to attach around the neck. More recently, some bibs have eliminated the strings and ties altogether and have instead used adhesive strips. These strips are located near the shoulder area on the backside of the bib and are used to adhere the bib to the wearer.

Although a wide variety of bib designs can be adequate to protect one's clothing, a bib, regardless of design, has no ability to clean and/or sanitize either a food contacting surface or any portion of the wearer's body. For such cleaning and/or sanitizing, one must separately utilize either an agent (e.g. antibacterial lotion) or item (cleansing wipe). It would be beneficial if the agent or item formed a part of or was packaged with the bib.

A need therefore exists for an improved bib.

SUMMARY OF THE INVENTION

The present invention relates to a bib for protecting clothing worn by a wearer. The bib comprises a sheet having front and back surfaces, an adhesive strip located on the back surface of the sheet and configured and dimensioned for adhering the sheet to the wearer, and a sealed package attached to the sheet. The sealed package includes a cleaning or sanitizing agent.

The cleaning or sanitizing agent can either be in the form of a towelette that includes the agent or a fluid alone that includes the agent. A release strip can be adhered to the adhesive strip, with the release strip being removable to thereby expose adhesive on the adhesive strip.

In one embodiment, the sheet includes a protective portion and a tear-away portion and the sealed package is positioned on the tear-away portion. The sheet can include perforations for separating the tear-away portion from the protective portion. The tear-away portion can also include a compartment separate from the sealed package. The tear-away portion can be provided with vertical perforations for separating the sealed package from the compartment.

In one embodiment, the sealed package is attached to the release strip. The release strip includes first and second faces, with the first face adhered to the adhesive strip and the sealed package attached to the second face. In another embodiment, there is no release strip and the sealed package is attached to the adhesive strip so that the sealed package itself covers the adhesive on the adhesive strip until removal.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 3*a* shows a back side of another embodiment of the bib according to the present invention.

FIG. 3*b* shows the back side of the bib of FIG. 3*a* with an adhesive strip exposed and a sealed packet separated.

DETAILED DESCRIPTION OF THE INVENTION

Figure 1A:
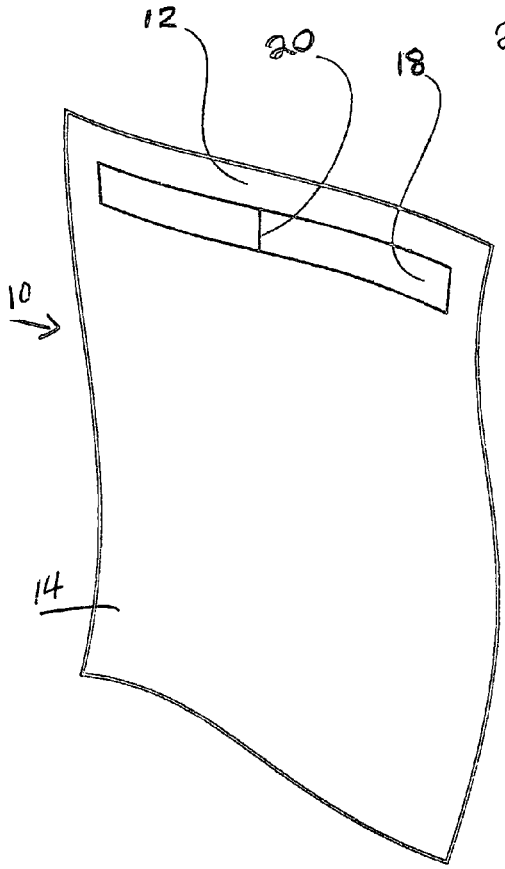
FIG. 1*a* shows a back side of an embodiment of the bib according to the present invention.
Figure 1B:
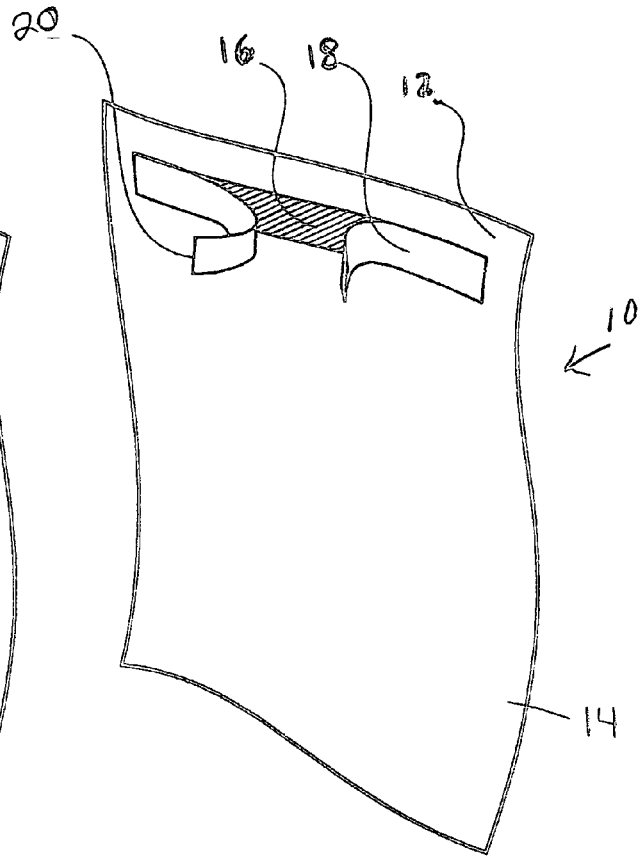
FIG. 1*b* shows the back side of the bib of FIG. 1*a* with a release strip partially removed from an adhesive strip.
Figure 1C:
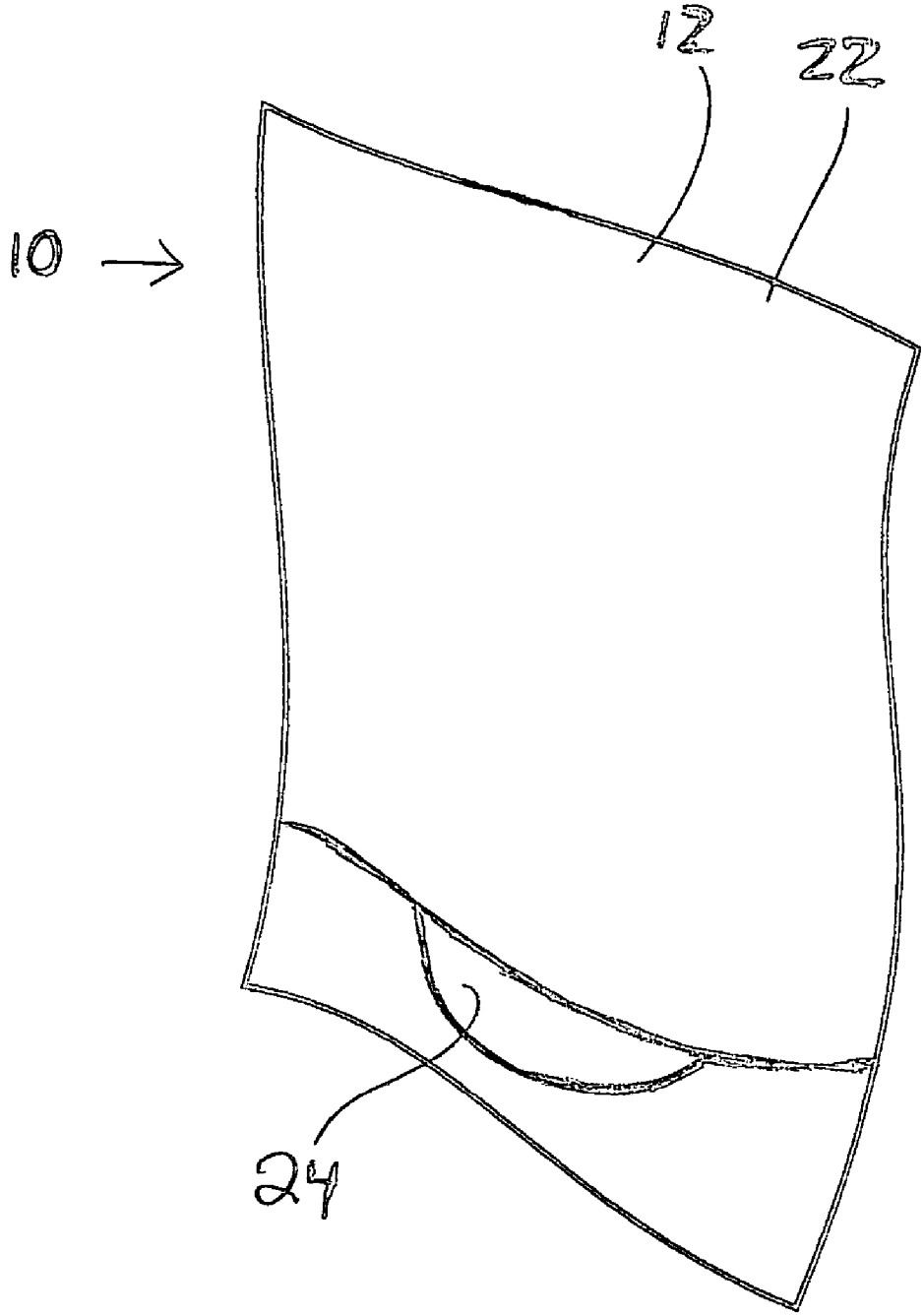
FIG. 1*c* shows a front side of the bib of FIG. 1*a*.

FIGS. 1*a-c* show a first embodiment of a bib 10 according to the present invention. Bib 10 can have many uses such as protecting the clothing worn by the wearer, providing a sterile barrier, etc. Although bib 10 is shown as a generally rectangular sheet 12, bib 10 could have any suitable shape. For example, bib 10 could be provided with a cutout at the upper edge to accommodate the neck of the wearer. With respect to dimensions, bib 10 can be provided in a wide variety of sizes, designed for the intended use and/or targeted to the intended wearer. In this regard, bib 10 is shown longer than wider. However, bib 10 can be made wider than longer for individuals having a large chest area.

Bib 10 can be made of any suitable material, such as cloth, plastic, paper or combinations thereof. The present invention contemplates that sheet 12 can be composed of multiple layers. For example, a top layer can be made of an absorbent, flexible paper material so that the top layer absorbs and catches any spilled substance, such as food or drink, and prevents it from damaging the clothes of the wearer. A bottom layer can also be made of an absorbent, flexible paper material, which can be identical to the top layer, and thus provides an additional layer of protection. A middle layer is sandwiched in between the top and bottom layers and is made of moisture resistant material, such as a thermoplastic film designed to repel liquid or moisture.

A back surface or side 14 of sheet 12 includes an adhesive strip 16 that is configured and dimensioned for adhering sheet 12 to the wearer. Adhesive strip 16 is shown near the upper edge of sheet 12, but can be positioned anywhere that once the adhesive is pressed against the wearer or the wearer's clothing, sheet 12 will remain in place. Additionally, adhesive strip 16 can be provided in multiple strips or other shapes or sizes so long as sheet 12 remains in place.

Until desired for use, a release strip 18 covers adhesive strip 16 and is removable to thereby expose the adhesive on adhesive strip 16. Release strip 18 can be provided in two halves, separated by a gap 20 to facilitate removal. Any other know mechanism to facilitate removal of release strip 18 from adhesive strip 16 can be used as an alternative or in conjunction with gap 20.

The adhesive used can be of the kind that do not become inactive but remain permanently active, and the adhesive capacity is adjusted depending on the strength properties of sheet 12. An example of a usable adhesive is the kind used for note pads of the type called POST-IT (trademark) which is a repositionable adhesive, wherein the note pad sheets can be temporarily adhered, removed and repositioned. For stronger adhesive capacity the adhesive used for self-adhesive tape can be used. However, the adhesive used is preferably of the kind that does not mark or otherwise permanently damage the surface to which it is adhered.

As best seen in FIG. 1*c*, a front surface or side 22 of sheet 12 can include a pocket or pouch 24 for holding or collecting any crumbs or other debris that slides along or fall near front surface 22. Front 22 and/or back surface 14 can include advertising and/or decorative, promotional, or other images or text.

Figures 2A, 2B:
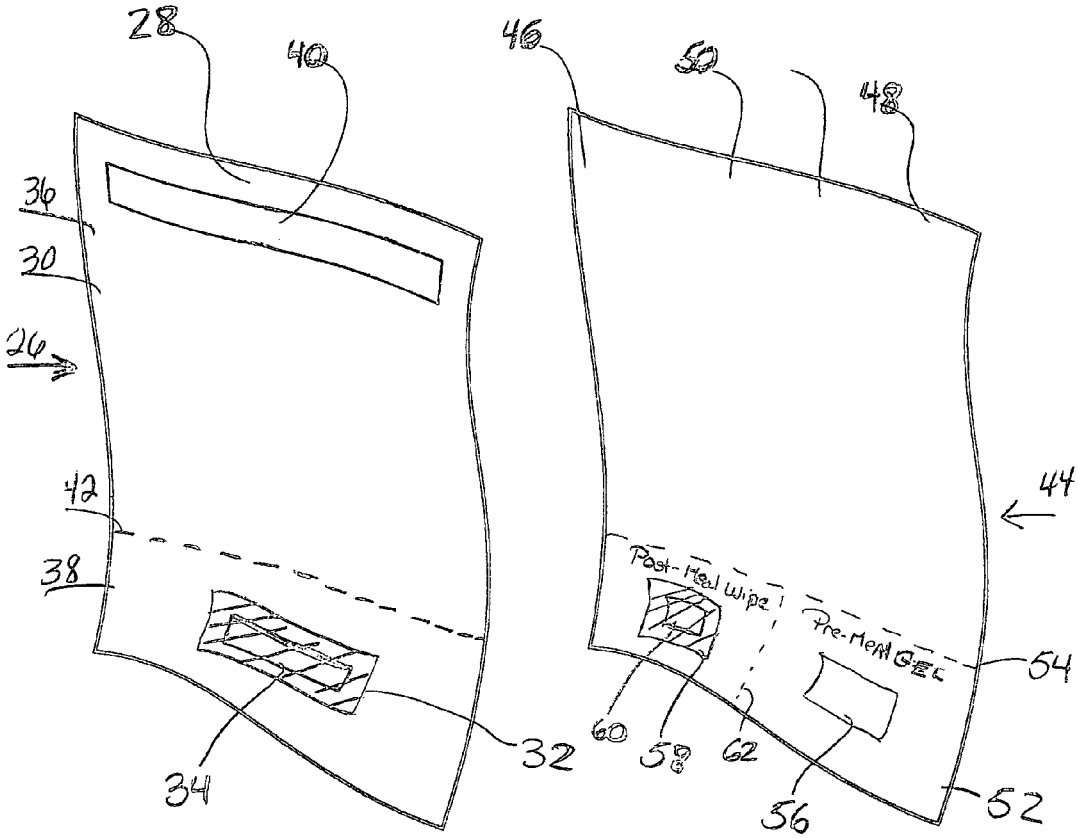
FIG. 2*a* shows a back side of another embodiment of the bib according to the present invention.
FIG. 2*b* shows a back side of an embodiment of the bib similar to the bib of FIG. 2*a*.

FIG. 2*a* shows another embodiment of a bib 26 according to the present invention. In general, most of the structure of bib 26 is like or comparable to the structure of bib 10. Accordingly, discussion of the like components is not believed necessary. Bib 26 has a sheet 28 that includes a back surface 30 and a front surface (not shown). Sealed package 32 is attached to sheet 28 and includes either a cleaning or sanitizing agent for cleaning and/or sanitizing a surface (for example the surface upon which food is to be placed) or a portion of the wearer (for example the hands of the wearer). The agent can be in the form of a wipe or towelette 34 that is pre-moistened or incorporates a fluid with cleaning or sanitizing properties. The agent could also be in the form of a fluid alone, such as a gel. Such a gel can include an anti-bacterial component.

In the embodiment of FIG. 2*a*, sheet 28 includes a protective portion 36 and a tear-away portion 38. Protective portion 36 is sized so that when a release strip 40 is removed to expose the adhesive, protective portion 36 is large enough to cover the area to be protected. Sealed package 32 is located on tear-away portion 38 so that tear-away portion 38 can be separated from protective portion 36 and put aside until use of towelette 34 is desired. Perforations 42 can be provided to facilitate separation of tear-away portion 38 from protective portion 36. It should be noted that although sealed package 32 is shown attached to back surface 30 of sheet 28, sealed package 32 could also be attached to the front surface.

FIG. 2*b* shows an embodiment of a bib 44 in which the sealed package is located on the front surface. In general, most of the structure of bib 44 is like or comparable to the structure of the bibs 10 and 26. Accordingly, discussion of the like components is not believed necessary. Bib 44 has a sheet 46 that includes a front surface 48 and a back surface (not shown). Sheet 46 includes a protective portion 50 and a tear-away portion 52, with perforations 54 provided to facilitate separation. Tear-away portion 52 includes a compartment 56 containing the sanitizing agent and a separate sealed package 58 containing towelette 60 with the cleaning agent. Vertical perforations 62 can be provided to separate the section of tear-away portion 52 that includes compartment 56 from the section of tear-away portion 52 that includes sealed package 58.

FIGS. 3*a* and 3*b* show another embodiment of a bib 64 according to the present invention. In general, most of the structure of bib 64 is like or comparable to the structure of bib 10, 26, and 44. Accordingly, discussion of the like components is not believed necessary. Bib 64 comprises a sheet 66 having front 68 and back 70 surfaces. An adhesive strip 72 is located on back surface 70 and is configured and dimensioned for adhering sheet 66 to the wearer. A sealed package 74 is attached to sheet 66 and includes a cleaning or sanitizing agent. In this regard, sealed package 74 can be attached to a release strip 76 with the release strip 76 being removable to thereby expose adhesive on adhesive strip 72. In particular, release strip 76 includes first 78 and second 80 faces, with first face 78 adhered to adhesive strip 72 and sealed package 74 attached to second face 80. Alternatively, the outer surface of sealed package 74 can serve as the release strip, covering the adhesive on adhesive strip 72 until it is removed. As was the case for previous embodiments, sealed package 74 can contain a towelette with the cleaning or sanitizing agent or sealed package 74 can contain a fluid with the cleaning or sanitizing agent.

The present invention contemplates that it may be advantageous to package the bibs according to the present invention in easy-to-dispense containers. Such containers can be portable, conveniently sized to fit in a diaper bag, hand bag, purse, glove compartment of a vehicle, etc. Such containers can also be attached to a wall or otherwise sized to be located on a desktop, counter surface, or other similar location. The containers can be single use, i.e. disposable when all the bibs are used or refillable with bibs when the supply of bibs is all used.

Figure 4A:
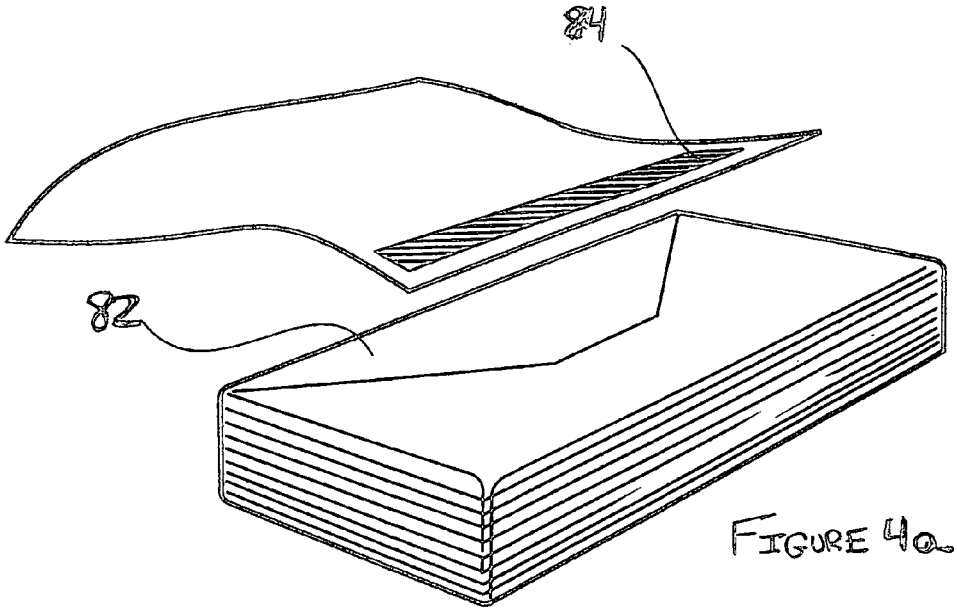
FIG. 4*a* shows a box-type dispenser for the bib of the present invention.
Figure 4B:
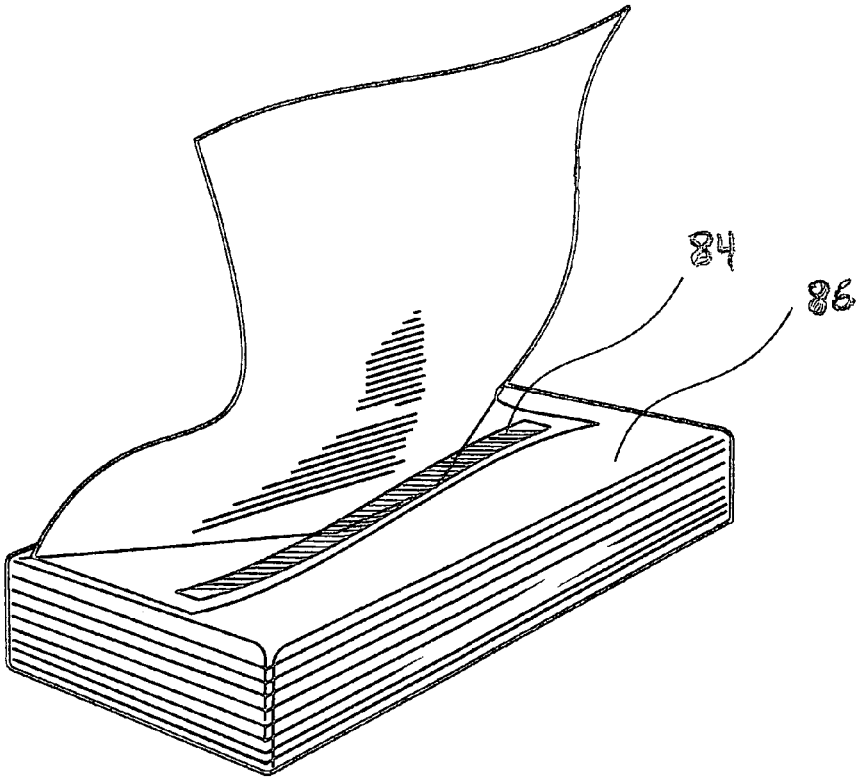
FIG. 4*b* shows a pouch-type dispenser for the bib of the present invention.

FIG. 4*a* shows a box-type dispenser 82 for a supply of bibs 84. Box-type dispenser 82 is akin to any desktop facial tissue box. FIG. 4*b* shows a pouch-type dispenser 86 for a supply of bibs 84. Pouch-type dispenser 86 is akin to the travel size facial tissue packets.

Figure 5:
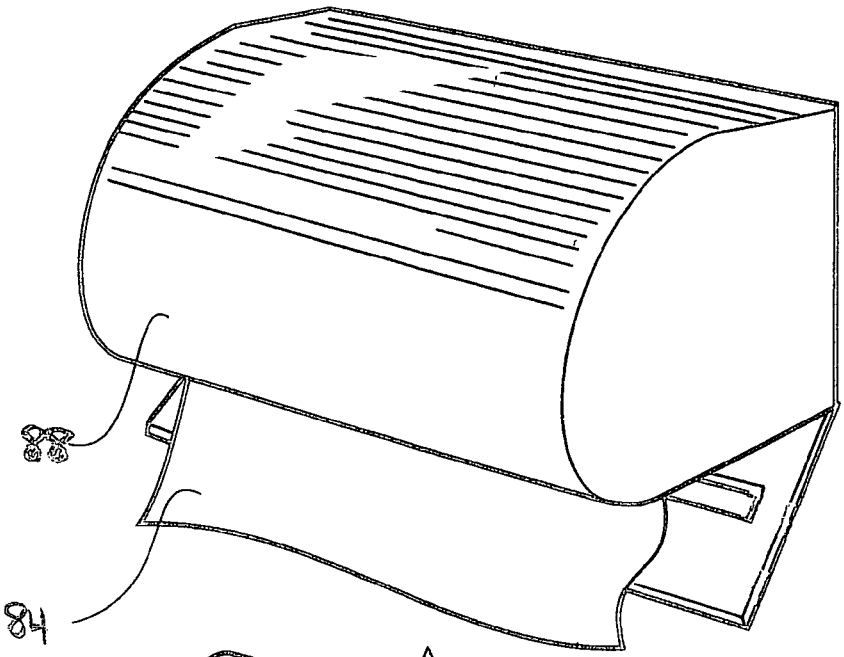
FIG. 5 shows a dispenser that can be used either as a roll-type dispenser or a folded-sheet type dispenser for dispensing the bib of the present invention.
Figure 6:
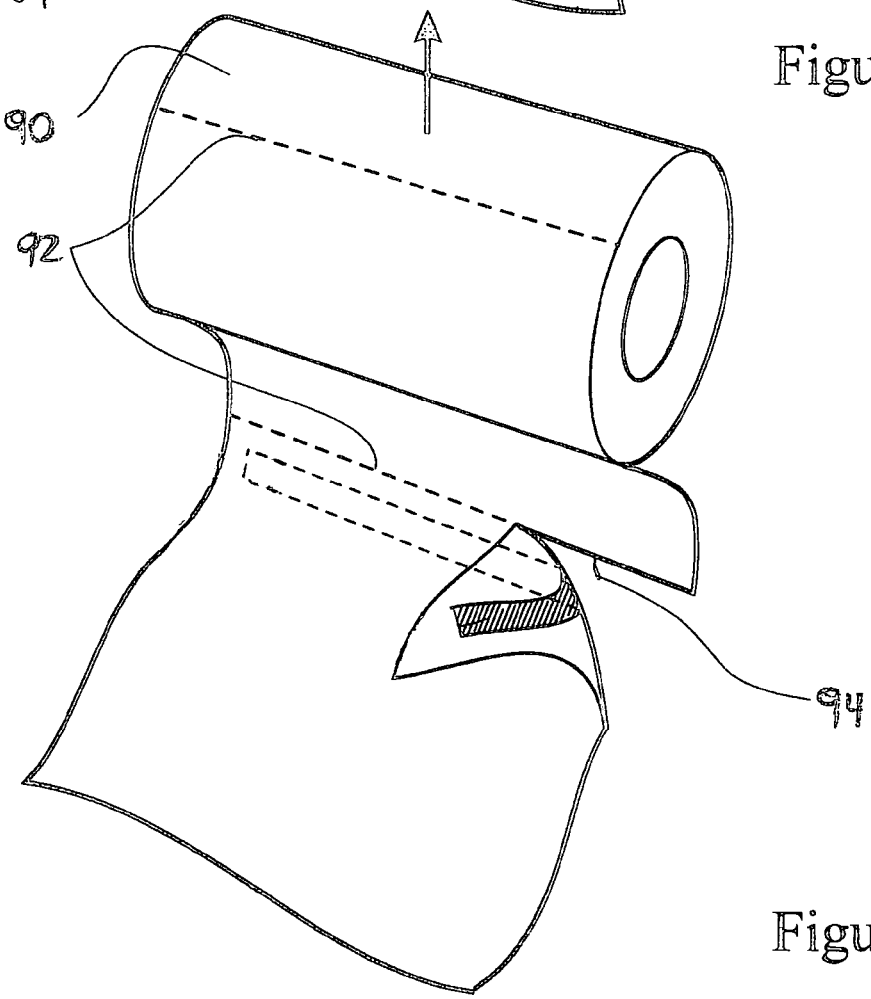
FIG. 6 shows a continuous roll of bibs of the present invention.

FIG. 5 shows a dispenser 88 that can be used either as a roll-type dispenser or a folded-sheet type dispenser for dispensing a supply of bibs 84. When dispenser 88 is a folded-sheet type dispenser, it operates analogous to well-known hand towel dispensers in which the hand towels are packaged such that removal of one towel results in the next towel being positioned for removal. When dispenser 88 is a roll-type dispenser, a continuous roll of bibs 90 as shown in FIG. 6 can be used. If desired, perforations 92 can separate the bibs. Additionally or as an alternative, the dispenser can include an edge 94 to assist in separating the bib to be used.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention. Therefore, it will be understood that the appended claims are intended to cover all such modifications and embodiments which come within the spirit and scope of the present invention.

What is claimed is:

1. A bib for protecting clothing worn by a wearer, the bib comprising:

a sheet having a front surface, a back surface, a protective portion, and a tear-away portion;

an adhesive strip located on the back surface of the protective portion of the sheet and configured and dimensioned for adhering the protective portion the sheet to the wearer; and a sealed package attached to the tear-away portion of the sheet, the sealed package including a cleaning or sanitizing agent.

2. The bib of claim 1 wherein the sheet includes perforations for separating the tear-away portion from the protective portion.

3. The bib of claim 2 wherein the tear-away portion includes the sanitizing agent.

4. The bib of claim 3 wherein the tear-away portion includes an anti-bacterial component.

5. The bib of claim 2 further comprising a release strip adhered to the adhesive strip, the release strip being removable to thereby expose adhesive on the adhesive strip.

6. The bib of claim 5 wherein the sealed package includes a towelette containing the cleaning agent.

7. The bib of claim 1 further comprising a release strip adhered to the adhesive strip, the release strip being removable to thereby expose adhesive on the adhesive strip.

8. A bib for protecting clothing worn by a wearer, the bib comprising:

a sheet having a front surface, a back surface, a protective portion and a tear-away portion;

an adhesive strip located on the back surface of the protective portion of the sheet and configured and dimensioned for adhering the protective portion of the sheet to the wearer;

a sealed package attached to the tear-away portion of the sheet, the sealed package including a cleaning agent; and a compartment attached to the tear-away portion of the sheet and separate from the sealed package the compartment including a sanitizing agent, wherein the sheet includes perforations for separating the tear-away portion from the protective portion.

9. The bib of claim 8 wherein the tear-away portion includes vertical perforations for separating the sealed package from the compartment.

10. The bib of claim 9 further comprising a release strip adhered to the adhesive strip, the release strip being removable to thereby expose adhesive on the adhesive strip.

11. The bib of claim 10 wherein the sealed package includes a towelette containing the cleaning agent.

* * * * *